US009587803B1

(12) United States Patent
Tickner et al.

(10) Patent No.: US 9,587,803 B1
(45) Date of Patent: Mar. 7, 2017

(54) HIGH VOLTAGE LIGHTING FIXTURE

(71) Applicant: Cooper Technologies Company, Houston, TX (US)

(72) Inventors: Jerold Alan Tickner, Newnan, GA (US); Christopher Lee Bohler, Peachtree City, GA (US); Ashok Deepak Shah, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/466,793

(22) Filed: Aug. 22, 2014

Related U.S. Application Data

(60) Provisional application No. 61/869,371, filed on Aug. 23, 2013.

(51) Int. Cl.

| | |
|---|---|
| ***F21V 13/14*** | (2006.01) |
| ***F21V 29/00*** | (2015.01) |
| ***F21K 99/00*** | (2016.01) |
| *F21Y 103/00* | (2016.01) |

(52) U.S. Cl.
CPC ..... *F21V 13/14* (2013.01); *F21K 9/56* (2013.01); *F21V 29/22* (2013.01); *F21Y 2103/003* (2013.01)

(58) Field of Classification Search
CPC . F21V 13/14; F21V 29/22; F21K 9/56; F21Y 2103/003
USPC .. 362/514, 516–518, 217.05, 241, 247, 245, 362/296.01, 297–299, 307, 296.05, 362/327–328, 341, 346
See application file for complete search history.

(56) References Cited

U.S. PATENT DOCUMENTS

| | | | | |
|---|---|---|---|---|
| 6,575,603 | B2 * | 6/2003 | Stahl | F21V 7/10 362/298 |
| 8,197,105 | B2 * | 6/2012 | Yang | A47F 3/001 362/217.05 |
| 8,684,566 | B2 * | 4/2014 | Bretschneider | F21V 7/22 362/217.05 |
| 2009/0101930 | A1 * | 4/2009 | Li | F21K 9/135 257/98 |

(Continued)

FOREIGN PATENT DOCUMENTS

KR 100937747 B1 * 1/2010

OTHER PUBLICATIONS

Machine translation of KR 100937747 B1.*

*Primary Examiner* — Anne Hines
*Assistant Examiner* — Jose M Diaz
(74) *Attorney, Agent, or Firm* — King & Spalding LLP

(57) ABSTRACT

A lighting fixture includes an elongated lens having an inner surface and an outer surface. The lighting fixture further includes a phosphor layer coupled to the inner surface of the elongated lens. The lighting fixture also includes a first reflector and a second reflector. The first reflector is attached to a first side surface of the elongated lens. The first side surface of the elongated lens is between the inner surface and the outer surface on a first elongated side of the lens. The second reflector is attached to a second side surface of the elongated lens. The second side surface of the elongated lens is between the inner surface and the outer surface on a second elongated side of the lens. The elongated lens, the phosphor layer, the first reflector, and the second reflector are extruded or molded as a single piece.

18 Claims, 9 Drawing Sheets

(56) References Cited

U.S. PATENT DOCUMENTS

| | | | | |
|---|---|---|---|---|
| 2010/0172152 | A1* | 7/2010 | Boonekamp | F21V 7/0008 362/609 |
| 2013/0170178 | A1* | 7/2013 | Yoo | G02B 6/4298 362/84 |
| 2013/0293098 | A1* | 11/2013 | Li | F21K 9/135 313/512 |
| 2014/0126196 | A1* | 5/2014 | Dixon | F21L 4/00 362/218 |
| 2014/0355243 | A1* | 12/2014 | Yu | F21K 9/56 362/84 |
| 2015/0263239 | A1* | 9/2015 | Watanabe | F21V 13/14 362/293 |

* cited by examiner

HIGH VOLTAGE LIGHTING FIXTURE

RELATED APPLICATIONS

The present application claims priority under 35 U.S.C. §119 to U.S. Provisional Patent Application No. 61/869,371, filed Aug. 23, 2013, and titled "High Voltage Lighting Fixture," the entire content of which is incorporated herein by reference.

TECHNICAL FIELD

The present disclosure relates generally to lighting solutions, and more particularly to a lighting fixture that can operate at high voltages.

BACKGROUND

A light fixture may include light sources and optics through which light from the light sources is emitted. For example, some light fixtures have a single optic. To illustrate, a light fixture may include a lens that is made, for example, from plastic. Some light fixtures may also include a lens with a remote phosphor. Such light fixtures are generally made by separately producing the lens and the remote phosphor layer individually and coupling the two together. Generally, the phosphor layer may enable more efficient illumination by a light fixture. However, efficiency of a light fixture may be undesirably reduced as a result of light escaping from the light fixture, for example, through edges of the optics and at attachment points of the optics and the phosphor layer with a printed circuit board or a reflector. Further, the means of attaching the optics and the phosphor layer with each other and, for example, a reflector may result in loss of efficiency of the light fixture.

Further, in some applications, light fixtures may operate at Class 1 voltage levels. For example, electrical connectors of such light fixtures may need to be separated by a particular distance (e.g., $3/8^{th}$ of an inch) in order to meet safety requirements. Such spacing requirement may result in a larger than desired dimension of the light fixture. Thus, a light fixture that has a relatively narrow spacing between electrical connectors and still operates at Class 1 voltage levels is desirable.

SUMMARY

In general, the present disclosure relates to a high voltage lighting fixture. In an example embodiment, a lighting fixture includes an elongated lens having an inner surface and an outer surface. The lighting fixture further includes a phosphor layer coupled to the inner surface of the elongated lens. The lighting fixture also includes a first reflector and a second reflector. The first reflector is attached to a first side surface of the elongated lens. The first side surface of the elongated lens is between the inner surface and the outer surface on a first elongated side of the lens. The second reflector is attached to a second side surface of the elongated lens. The second side surface of the elongated lens is between the inner surface and the outer surface on a second elongated side of the lens. The elongated lens, the phosphor layer, the first reflector, and the second reflector are extruded or molded as a single piece.

In another example embodiment, a lighting fixture includes one or more light emitting diodes (LEDs) and a power printed circuit board (PCB) attached to an end cap. A first electrical connector and a second electrical connector are attached to the power PCB. The lighting device includes a lighting PCB. The one or more LEDs are disposed on the lighting PCB. A third electrical connector and a fourth electrical connector are attached to the lighting PCB. The third electrical connector is fittingly coupled to the first electrical connector, and the fourth electrical connector is fittingly coupled to the second electrical connector. A first electrically conductive trace of the lighting PCB is coupled to the third electrical connector and to the one or more LEDs. A second electrically conductive trace of the lighting PCB is coupled to the fourth electrical connector and to the one or more LEDs.

These and other aspects, objects, features, and embodiments will be apparent from the following description and the claims.

BRIEF DESCRIPTION OF THE FIGURES

Reference will now be made to the accompanying drawings, which are not necessarily drawn to scale, and wherein.

Figure 1:
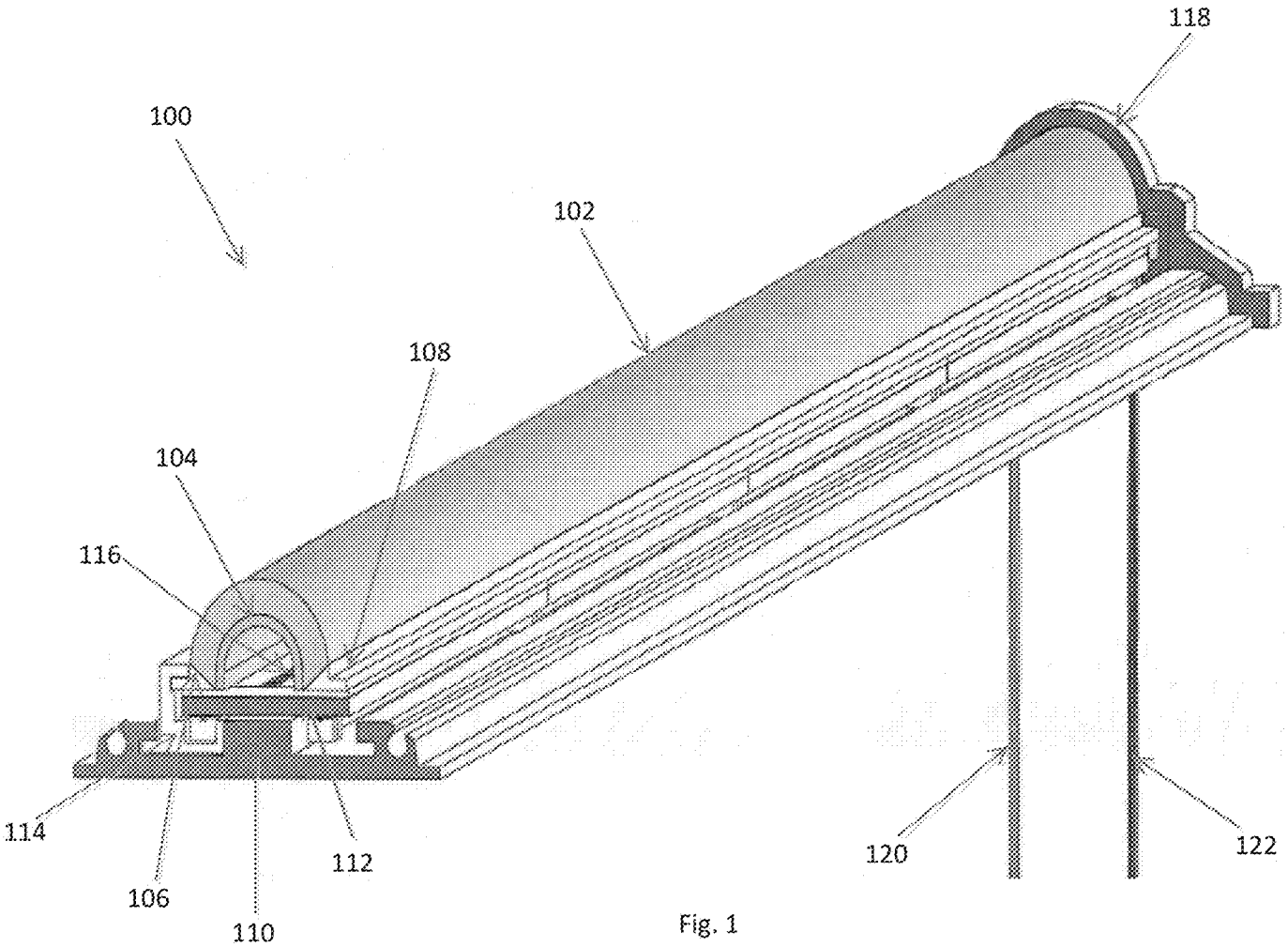
FIG. 1 illustrates a lighting fixture in accordance with an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Turning now to the figures, particular embodiments are described. FIG. 1 is a lighting fixture in accordance with an example embodiment. The lighting fixture 100 includes an elongated lens 102, a phosphor layer 104, a first reflector 106, and a second reflector 108. The phosphor layer 104 is attached to the inner surface of the lens 102. In an example embodiment, the lens 102 and the phosphor layer 104 have a substantially semi-circular cross-section as illustrated in FIG. 1. In alternative embodiments, the lens 102 and the phosphor layer 104 may have other cross-sectional shapes without departing from the scope of this disclosure. In some example embodiments, the lens 102 may be made from a plastic material. As known to those skilled in the art, the phosphor layer 104 includes a material that emits light by luminescence.

The first reflector 106 and the second reflector 108 are attached to opposite sides of the lens 102. The first reflector 106 and the second reflector 108 are made from a highly reflective material and are intended to reduce the amount of light that escapes from the lens 102 through the side surfaces of the lens 102. For example, the first reflector 106 and the second reflector 108 may reflect approximately 97% of the light that reaches them through the lens 102 back toward the lens 102, which improves efficiency of the lighting fixture 100. The first reflector 106 and the second reflector 108 may be made from one or more of silicone, rubber, EPDM, neoprene, or similar white or specular material.

In some example embodiments, the elongated lens 102, the phosphor layer 104, the first reflector 106, and the second reflector 108 are made by extrusion. To illustrate, the elongated lens 102, the phosphor layer 104, the first reflector 106, and the second reflector 108 can be extruded as a single piece, which improves reliability and reduces production cost by simplifying the production process.

The lighting fixture 100 further includes a lighting printed circuit board (PCB) 112 and a plurality of LEDs 116 that are positioned on the lighting PCB 112. The plurality of LEDs 116 are oriented to emit light towards the phosphor layer 104, which is attached to the inner surface of the lens 102. The lighting fixture 100 also includes a heat sink 110. The lighting PCB 112 is positioned close to or in contact with the heat sink 110, which is designed to dissipate heat from the lighting PCB 112. In an example embodiment, the heat sink 110 may be made by extrusion. For example, the heat sink 110 may be made from aluminum. In some example embodiments, the heat sink 110 may include various channels that enable other components of the lighting fixture 100 to be positioned below the lighting PCB while the lighting PCB is physically close to or in contact with a portion of the heat sink 110.

The lighting fixture 100 further includes an isolation extrusion 114 that is designed to isolate current carrying connectors from each other. The isolation extrusion 114 may be made from an electrically insulating material, such as a plastic material. For example, the isolation extrusion 114 may enable the lighting fixture 100 to operate at Class 1 voltage levels (e.g., above 60 volts) by providing adequate separation of the connectors illustrated in FIGS. 2, 4, and 5. Class 1 requirements may be found in the National Electrical Code (NEC), particularly NEC NFPA70, which is incorporated herein by reference.

Figure 9:
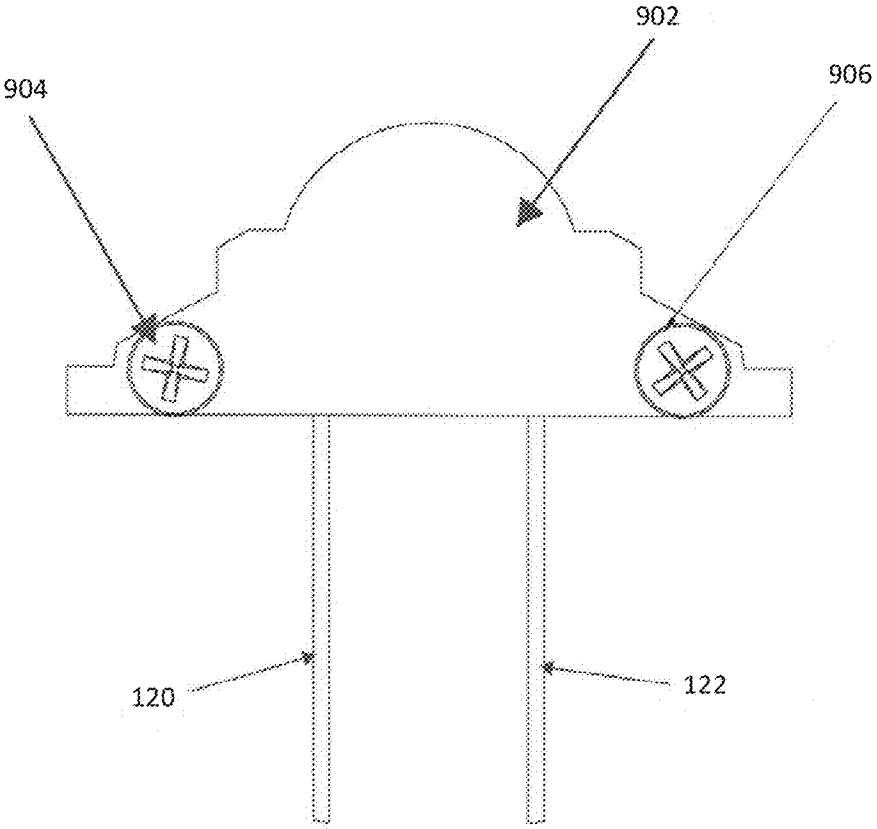
FIG. 9 illustrates a second end cap of the lighting fixture in accordance with an example embodiment.

The lighting fixture 100 further includes a power end cap 118 that is positioned at one end of the lighting fixture 100. A second end cap, which is illustrated in FIG. 9 and not shown in FIG. 1 to enable illustration of other components, may be attached to another end of the lighting fixture 100. A power PCB (illustrated in FIG. 4) is attached to the power end cap. A first wire 120 and a second wire 122 are attached to connectors coupled to the power PCB and provide power to the plurality of LEDs 116. For example, the first wire 120 and the second wire 122 may be connected to a power supply.

Figure 2:
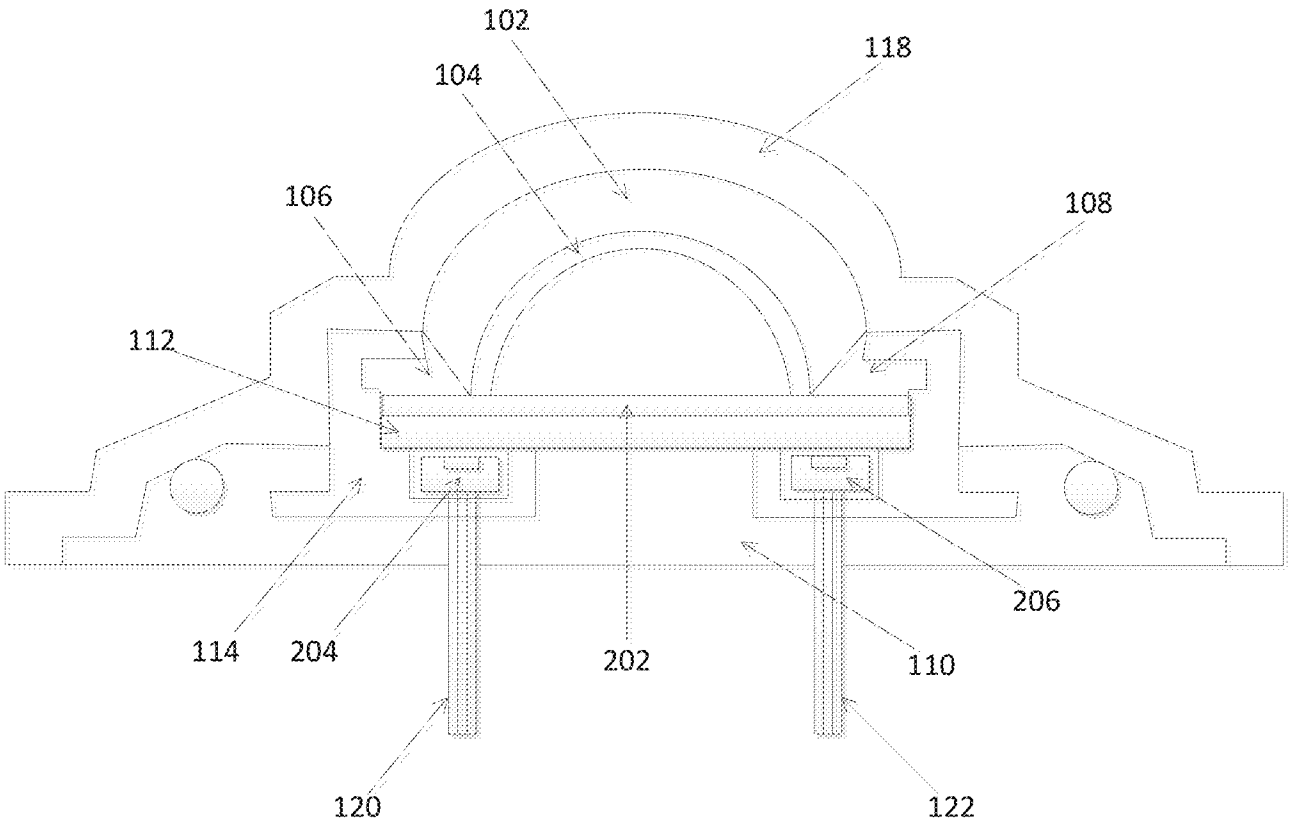
FIG. 2 illustrates a cross-sectional view of the lighting fixture of FIG. 1 in accordance with an example embodiment.
Figure 7:
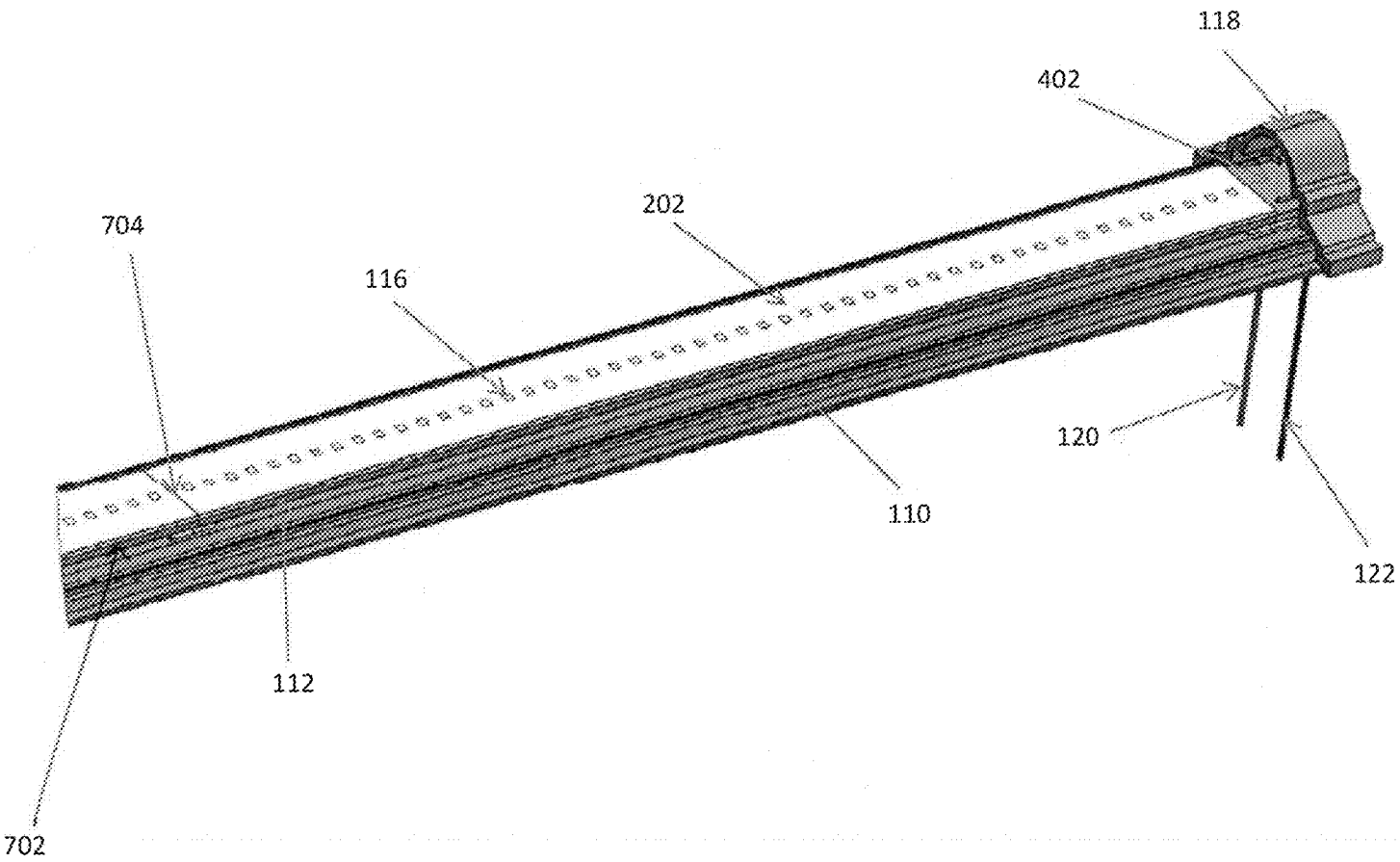
FIG. 7 illustrates a reflective layer positioned on the lighting PCB of the lighting fixture in accordance with an example embodiment.

Referring to FIG. 2, FIG. 2 illustrates a cross-sectional view of the lighting fixture of FIG. 1 in accordance with an example embodiment. For the sake of brevity, some of the components of the lighting fixture 100 described with respect to FIG. 1 may not be described with respect to FIG. 2. As illustrated in FIG. 2, the lighting fixture 100 may include a reflective layer 202 attached to a first side of the lighting PCB 112 facing the phosphor layer 104. For example, the reflective layer 202 may be attached to the first side of the lighting PCB 112 using an adhesive. The reflective layer 202 is designed to reflect light toward the phosphor layer 104 to improve efficiency of the lighting fixture 100. For example, the reflective layer 202 may reflect light directly from the plurality of LEDs 116 shown in FIG. 1 and may reflect back light reflected toward the reflective layer 202 by the phosphor layer 104. As illustrated in FIG. 7, the reflective layer 202 may include one or more cutout areas that enable the plurality of LEDs 116 to emit light toward the phosphor layer 104.

As illustrated in FIG. 2, the lighting fixture 100 includes a first electrical connector 204 and a second electrical connector 206. The first electrical connector 204 and the second electrical connector 206 are coupled to the lighting PCB 112 and are designed to provide power connections to the plurality of LEDs 116. For example, the first electrical connector 204 and the second electrical connector 206 may be soldered to the lighting PCB 112. A first conductive trace that runs along the lighting PCB 112 may be electrically coupled to the first electrical connector 204 and to the plurality of LEDs 116. Similarly, a second conductive trace that runs along the lighting PCB 112 may be electrically coupled to the second electrical connector 206 and to the plurality of LEDs 116. The first electrical connector 204 and the second electrical connector 206 are designed to be fittingly coupled to corresponding electrical connectors (illustrated in FIG. 5) that are attached to a power PCB. The isolation extrusion 114 is positioned around a portion of the first electrical connector 204 (and a corresponding electrical connector of the power PCB) and isolates the first electrical connector 204 from the second electrical connector 206 (and a corresponding electrical connector of the power PCB).

Figure 3:
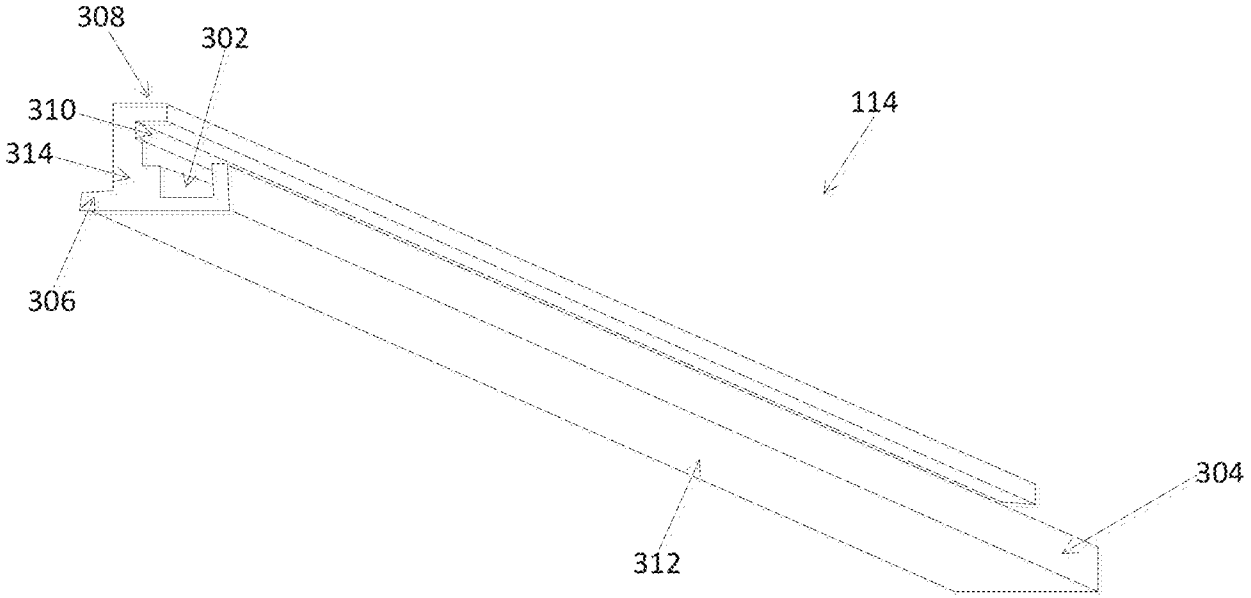
FIG. 3 illustrates the isolation extrusion shown in FIG. 1 in accordance with an example embodiment.

FIG. 3 illustrates the isolation extrusion 114 shown in FIG. 1 in accordance with an example embodiment. The isolation extrusion 114 includes a first channel 302 having an outer wall 304 that may be positioned next to a side of an electrical connector (e.g., the electrical connector 204) that faces another electrical connector (e.g., the electrical connector 206). The isolation extrusion 114 further includes a lower protrusion 306 that may be positioned in a channel of the heat sink 110 illustrated FIGS. 1 and 2. For example, the isolation extrusion 114 may be slid into the heat sink 110 at either end of the heat sink 110 such that a lower surface 312 of the isolation extrusion 114 is in contact with a surface of a channel of the heat sink 110. Positioning of the lower protrusion 306 in the channel of the heat sink 110 may help secure the isolation extrusion 114 in place.

The isolation extrusion 114 further includes an upper protrusion 308 that extends from a main wall 314 of the isolation extrusion 114. For example, the upper protrusion 308 may be positioned over a portion of the first reflector 106 shown in FIG. 1. The isolation extrusion 114 also include a second channel 310 for placement of a portion of the first reflector 106. The positioning of the portion of the first reflector 106 in the second channel 310 and the positioning of the upper protrusion 308 over the first reflector 106 may help maintain the isolation extrusion 114 in place by minimizing movement of the isolation extrusion 114.

Figure 4:
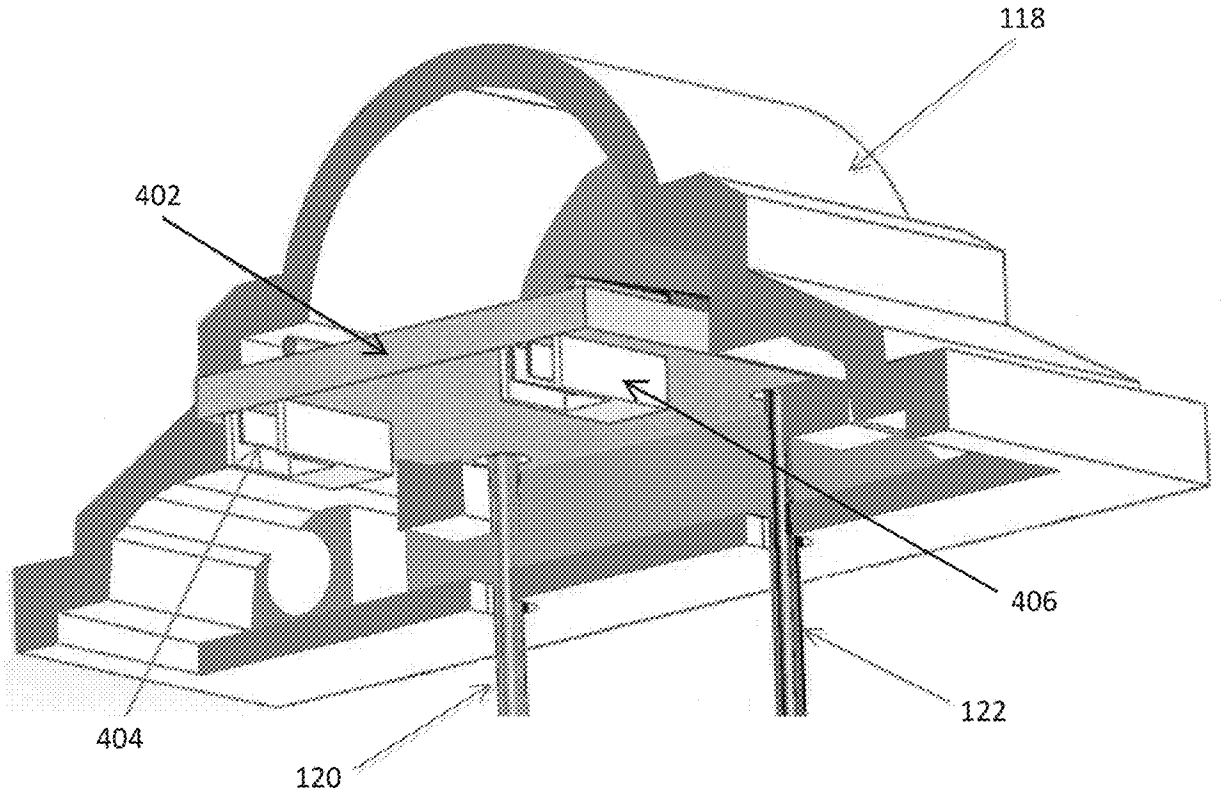
FIG. 4 illustrates a power printed circuit board (PCB) of the lighting fixture attached to a power end cap of the lighting fixture in accordance with an example embodiment.

FIG. 4 illustrates a power PCB 402 attached to the power end cap 118 of the lighting fixture in accordance with an example embodiment. The power PCB 402 may be attached to the power end cap 118 by various means, such as using one or more screws. A first electrical connector 404 and a second electrical connector 406 are attached to a surface of the power PCB 118. For example, as illustrated in FIG. 4, the first electrical connector 404 and the second electrical connector 406 may be attached (e.g., soldered) to a bottom side of the power PCB 402. The first wire 120 extends through an opening in the power PCB 402 and is electrically attached to the first electrical connector 404. For example, the first wire 120 may be soldered to the same electrical node as the first electrical connector 404. Similarly, the second wire 122 extends through an opening in the power PCB 402 and is electrically attached to the second electrical connector 406. For example, the second wire 122 may be soldered to the same electrical node as the second electrical connector 406.

Figure 5:
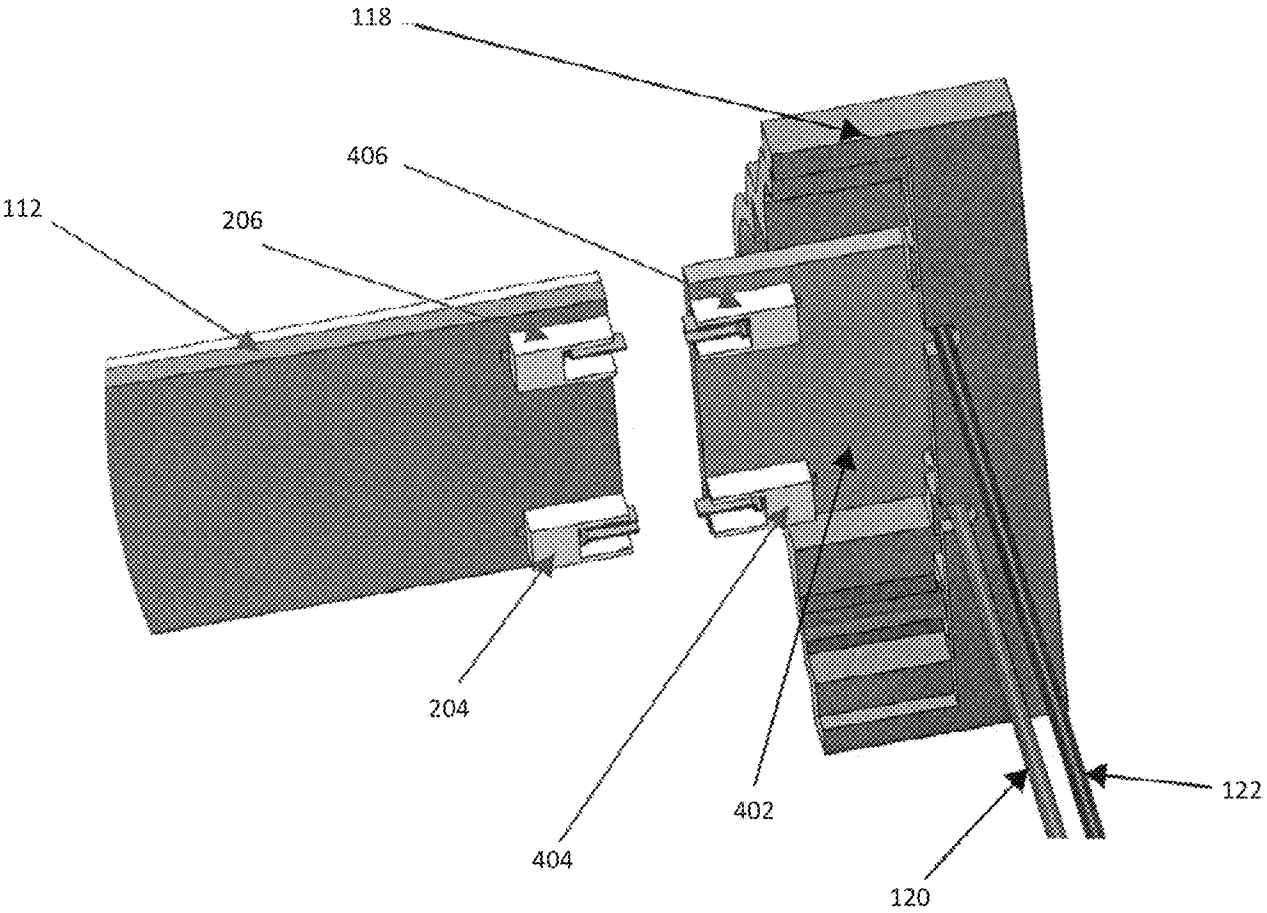
FIG. 5 illustrates corresponding electrical connectors attached to the power PCB and a lighting PCB of the lighting fixture in accordance with an example embodiment.

FIG. 5 illustrates corresponding electrical connectors attached to the power PCB and a lighting PCB of the lighting fixture in accordance with an example embodiment. The first electrical connector 204 of the lighting PCB 112 is positioned such that it can be fittingly coupled to the first electrical connector 404 of the power PCB 402. For example, the first electrical connector 204 of the lighting PCB 112 may be a female connector, and the first electrical connector 404 of the power PCB 402 may be a matching male connector that is designed to fit (for example, by sliding, plugging, or snapping) into the first electrical connector 204 or vice versa. To illustrate, the first electrical connector 204 and the first electrical connector 404 can be fittingly coupled to each other by sliding them together. In some example embodiments, the first electrical connector 204 and the first electrical connector 404 can also be designed to fittingly couple to each other by snapping, plugging, or any other suitable method for connecting them.

Similarly, the second electrical connector 206 of the lighting PCB 112 is positioned such that it can be fittingly coupled to the second electrical connector 406 of the power PCB 402. For example, the second electrical connector 206 of the lighting PCB 112 may be a female connector, and the second electrical connector 406 of the power PCB 402 may be a matching male connector that is designed to fit (for example, by sliding, plugging, or snapping) into the second electrical connector 206 or vice versa. To illustrate, the second electrical connector 206 and the second electrical connector 406 can be fittingly coupled to each other by sliding them together. In some example embodiments, the second electrical connector 206 and the second electrical connector 406 can also be designed to fittingly couple to each other by snapping, plugging, or any other suitable method for connecting them. As explained with respect to FIG. 4, the first wire 120 may extend through the power PCB 402 and may be electrically coupled to the first electrical connector 404 of the power PCB 402. Similarly, the second wire 122 may extend through the power PCB 402 and may be electrically coupled to the second electrical connector 406 of the power PCB 402.

When the first electrical connector 204 is attached to the first electrical connector 404 as illustrated in FIG. 5, an electrical path is established from the first wire 120 to the first connector 204. Similarly, when the second electrical connector 206 is attached to the second electrical connector 406, an electrical path is established from the second wire 122 to the second connector 206.

Figure 6:
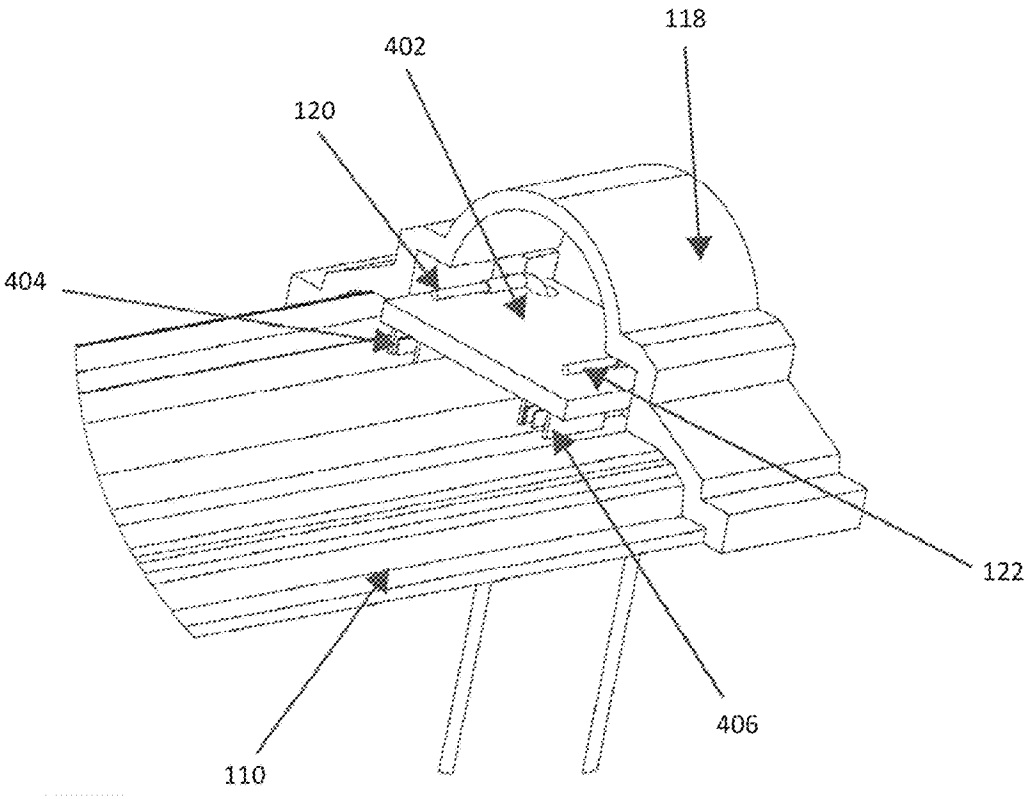
FIG. 6 illustrates a close-up view of the power end cap attached to a heat sink of the lighting fixture in accordance with an example embodiment.

FIG. 6 illustrates a close-up view of the power end cap attached to a heat sink of the lighting fixture in accordance with an example embodiment. As illustrated in FIG. 6, an end portion of the heat sink 110 fits within the power end cap 118 below the power PCB 402. The power end cap 118 is designed to accommodate the different segments of the heat sink 110. For example, the power end cap 118 may slide onto the heat sink 110 into the position illustrated in FIG. 6. Further, a portion of the heat sink 110 may be close to or in contact with a bottom side of the power PCB 402 while the first electrical connector 404 and the second electrical connector 406 are positioned in respective channels of the heat sink 110, as illustrated, for example, in FIG. 2.

FIG. 7 illustrates a reflective layer positioned on the lighting PCB of the lighting fixture in accordance with an example embodiment. The reflective layer 202 may include a plurality of openings to allow the plurality of LEDs 116 to extend through and/or emit light through. The reflective layer may be made from one or more of silicone, rubber, EPDM, neoprene, or similar white or specular material.

In some example embodiments, the lighting PCB 112 may be coupled to a second lighting PCB 702 at an attachment marker 704. Power may be provided to LEDs disposed on the second lighting PCB 702 via electrical connectors similar to the electrical connectors 204, 206, 404, and 406. The lighting PCB 112 and the second lighting PCB 702 may be positioned on the same heat sink 110. The isolation extrusion 114 shown in FIG. 3 may extend such that it is positioned around all electrical connectors that are positioned along one side of the power PCB 402, the lighting PCB 112, and the second lighting PCB 702.

Figure 8:
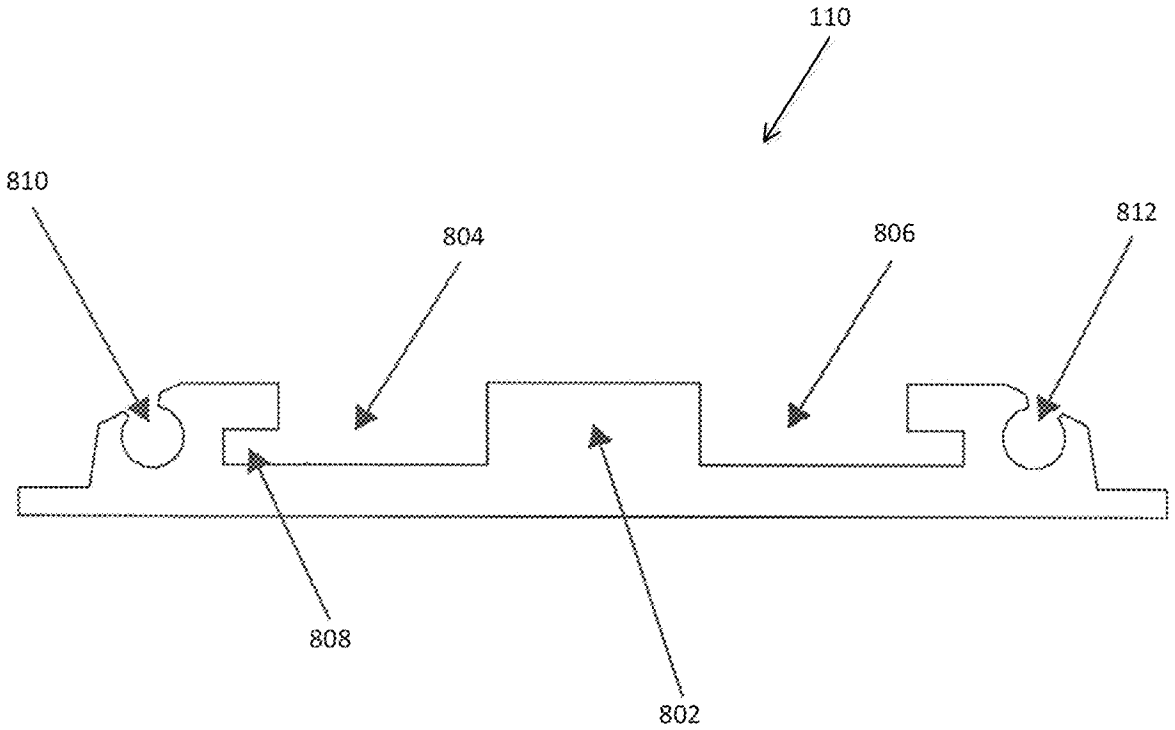
FIG. 8 illustrates the heat sink of the lighting fixture in accordance with an example embodiment.

FIG. 8 illustrates the heat sink 110 of the lighting fixture 100 in accordance with an example embodiment. The heat sink 110 has a middle segment 802 that is designed to have a surface positioned close to the lighting PCB 112, the power PCB 402, and the second lighting PCB 702 (if present). The middle segment 802 is designed to facilitate heat transfer from the PCBs to the heat sink 110. The heat sink 110 also includes a first channel 804 and a second channel 806. The isolation extrusion 114 may be partially positioned in the first channel 804 as illustrated in FIG. 2. Further, the electrical connectors (e.g., 204, 404) may also be partially positioned within the first channel 804 with a portion of the isolation extrusion 114 around them. The electrical connectors (e.g., 206, 406) may be at least partially positioned within the second channel 806. The channels 804 and 806 enable positioning of the middle segment 802 close to or in contact with the PCBs to effectively dissipate heat from the PCBs.

The heat sink 110 also includes a third channel 808, where the bottom protrusion 306 of the isolation extrusion 114 may be positioned. The attachment channels 810 and 812 enable attachment of the power end cap 118 and a second end cap shown in FIG. 9 to the heat sink 110. For example, screws may be used to attach the power end cap 118 to the heat sink 110.

FIG. 9 illustrates a second end cap of the lighting fixture in accordance with an example embodiment. As illustrated, the second end cap 902 may be attached to the heat sink 110 using screws 904, 906. The second end cap 902 is attached to an end portion of the heat sink 110 that is an opposite end of the heat sink 110 to which the power end cap 118 attached. Both the power end cap 118 and the second end cap 902 may be made from a material such as aluminum.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting fixture, comprising:

an elongated lens having a curved inner surface and a curved outer surface;

a phosphor layer coupled to the inner surface of the elongated lens;

a first reflector attached to a first side surface of the elongated lens, wherein the first side surface of the elongated lens is between the inner surface and the outer surface on a first elongated side of the lens;

a second reflector attached to a second side surface of the elongated lens, wherein the second side surface of the elongated lens is between the inner surface and the outer surface on a second elongated side of the lens and wherein the elongated lens, the phosphor layer, the first reflector, and the second reflector are extruded or molded as a single piece; and a lighting printed circuit board (PCB) attached to the first reflector and the second reflector, wherein a first electrical connector and a second electrical connector are attached to the lighting PCB on a side of the lighting PCB facing away from the first reflector and the second reflector, and wherein an isolation extrusion is positioned around the first electrical connector preventing electrical exposure of the first electrical connector to the second electrical connector through air.

2. The lighting fixture of claim 1, further comprising a plurality of light emitting diodes (LEDs) disposed on the lighting PCB, wherein the plurality of LEDs are attached to the lighting PCB on the first side of the lighting PCB to emit light towards the phosphor layer.

3. The lighting fixture of claim 1, further comprising a heat sink disposed below the lighting PCB to dissipate heat from the lighting PCB.

4. The lighting fixture of claim 1, further comprising a reflector attached or applied to a surface of the lighting PCB on the first side of the lighting PCB.

5. The lighting fixture of claim 1, wherein the first reflector and the second reflector are made from one or more of silicone, rubber, EPDM, or neoprene.

6. The lighting fixture of claim 1, wherein a portion of the isolation extrusion is positioned within a channel of a heat sink disposed below the lighting PCB to dissipate heat from the lighting PCB.

7. A lighting fixture, comprising:

one or more light emitting diodes (LEDs);

a power printed circuit board (PCB) attached to an end cap, wherein a first electrical connector and a second electrical connector are attached to the power PCB; and a lighting PCB, wherein the one or more LEDs are disposed on the lighting PCB, wherein a third electrical connector and a fourth electrical connector are attached to the lighting PCB, wherein the power PCB and the lighting PCB are coupled to each other by the first electrical connector, the second electrical connector, the third electrical connector, and the fourth electrical connector, wherein the third electrical connector is fittingly coupled to the first electrical connector, wherein the fourth electrical connector is fittingly coupled to the second electrical connector, wherein a first electrically conductive trace of the lighting PCB is coupled to the third electrical connector and to the one or more LEDs, and wherein a second electrically conductive trace of the lighting PCB is coupled to the fourth electrical connector and to the one or more LEDs.

8. The lighting fixture of claim 7, further comprising a heat sink disposed below the lighting PCB and the power PCB to dissipate heat from the lighting PCB and the power PCB.

9. The lighting fixture of claim 8, further comprising an isolation extrusion positioned to isolate electrically the first electrical connector and the third electrical connector from the second electrical connector and the fourth electrical connector, wherein the first electrical connector and the second electrical connector are attached to the power PCB on a side of the power PCB facing the heat sink and wherein the third electrical connector and the fourth electrical connector are attached to the lighting PCB on a side of the lighting PCB facing the heat sink.

10. The lighting fixture of claim 9, wherein the first electrical connector and the third electrical connector are positioned in a channel of the isolation extrusion.

11. The lighting fixture of claim 9, wherein a portion of the isolation extrusion is positioned in a channel of the heat sink.

12. The lighting fixture of claim 8, further comprising a first electrical wire and a second electrical wire, wherein the first electrical wire is coupled to the first electrical connector and wherein the second wire is coupled to the second electrical connector.

13. The lighting fixture of claim 7, further comprising a second lighting PCB attached the lighting PCB, wherein the second lighting PCB includes a plurality of LEDs and wherein power is provided to the plurality of LEDs through electrical connections disposed on the lighting PCB and the second lighting PCB.

14. The lighting fixture of claim 7, further comprising:

an elongated lens having an inner surface and an outer surface; and a phosphor layer coupled to the inner surface of the elongated lens, wherein the one or more LEDs to emit light toward an inner surface of the phosphor layer.

15. The lighting fixture of claim 7, further comprising a reflector attached or applied to a surface of the lighting PCB on the first side of the lighting PCB, the reflector having openings for the one or more LEDs to emit light therethrough.

16. A lighting fixture, comprising:

an elongated lens having an inner surface and an outer surface, wherein the inner surface and the outer surface are on opposite sides of the elongated lens;

a phosphor layer coupled to the inner surface of the elongated lens;

a first reflector attached to a first side surface of the elongated lens, wherein the first side surface of the elongated lens extends between the inner surface and the outer surface on a first elongated side of the lens;

a second reflector attached to a second side surface of the elongated lens, wherein the second side surface of the elongated lens extends between the inner surface and the outer surface on a second elongated side of the lens and wherein the elongated lens, the phosphor layer, the first reflector, and the second reflector are extruded or molded as a single piece; and a lighting printed circuit board (PCB) attached to the first reflector and the second reflector, wherein a first electrical connector and a second electrical connector are attached to the lighting PCB on a side of the lighting PCB facing away from the first reflector and the second reflector, wherein an isolation extrusion is positioned around the first electrical connector preventing electrical exposure of the first electrical connector to the second electrical connector through air.

17. The lighting fixture of claim 16, wherein a portion of the isolation extrusion is positioned within a channel of a heat sink disposed below the lighting PCB to dissipate heat from the lighting PCB.

18. The lighting fixture of claim 16, further comprising a reflector attached or applied to a surface of the lighting PCB on the first side of the lighting PCB.

* * * * *